United States Patent [19]

Wei

[11] Patent Number: 4,925,405

[45] Date of Patent: May 15, 1990

[54] DIN-TYPE CONNECTOR

[76] Inventor: Mu K. Wei, No. 6, Alley 2, Lane 68, Min Feng Rd., Yang Mei Chen, Tao Yuan Hsien, Taiwan

[21] Appl. No.: 324,719

[22] Filed: Mar. 17, 1989

[51] Int. Cl.[5] ..... H01R 13/648

[52] U.S. Cl. ..... 439/608; 439/609

[58] Field of Search ..... 439/607, 608, 609, 610, 439/612, 62

[56] References Cited

U.S. PATENT DOCUMENTS

| | | | |
|---|---|---|---|
| 4,329,665 | 5/1982 | Kawai | 439/607 |
| 4,389,080 | 6/1983 | Clark et al. | 439/607 X |
| 4,407,552 | 10/1983 | Watanabe et al. | 439/608 |
| 4,500,159 | 2/1985 | Briones et al. | 439/607 |
| 4,580,858 | 4/1986 | Daberkoe | 439/62 |
| 4,620,762 | 11/1986 | Davis et al. | 439/607 X |
| 4,659,163 | 4/1987 | Althouse et al. | 439/608 |

*Primary Examiner*—William Briggs

*Attorney, Agent, or Firm*—Morton J. Rosenberg; David I. Klein

[57] ABSTRACT

A DIN connector comprising a main body and a metallic hull which encases four sides of the main body. The main body has two grounding terminals which can be inserted into two corresponding holes on the hull to ensure the mechanical and electrical connection between the main body and the hull. To further ensure the electrical connection, the hull is provided with two tongues which resiliently urge on the terminals when the main body and the hull and engaged with each other.

2 Claims, 4 Drawing Sheets

DIN-TYPE CONNECTOR

The present invention relates to DIN connector, and in particular to an improved DIN connector which is shielded against external interference and which is easy to assemble.

A conventional DIN connector, like the one shown in FIG. 4, is formed by a main body (a) substantially in form of a metal hull (b). The main body is provided with two grounding terminals (c), below which there is respectively provided with a notch (d), into which a projection formed an each inner side of the hull (b) can be engaged to prevent the forward-rearward shift of the hull (b) on the main body (a). The hull (b) has an inverted U shape with the sites corresponding to the terminals (c) provided with recesses (f) to receive the terminals (c). After the hull (b) is mounted onto the main body, the two terminals (c) are further soldered onto the recesses (9*f*) to ensure their mechanical and electrical connection with the hull (b), so that the latter has the function of grounding, in order to shield the connector from the interference of external signals.

However, this DIN connector suffers some disadvantages. Firstly, the metallic hull provides shield only for three sides (X), (Y) and (Z), while the rear side where the recesses (f) are provided still remains exposed to the external electromagnetic waves. Secondly, the work to assemble the two parts (a), (b) together is relatively complicated, since a soldering step is required.

Accordingly, it is the object of this invention to provide an improved DIN connector whereby the aforesaid disadvantages are obviated.

According to the present invention, the first disadvantage is obviated by providing the hull with an additional shield on the rear side which is otherwise open in the coventional DIN connector and which makes a dead corner of the shielding thereof.

According to another feature of this invention, the aforesaid second disadvantage is obviated by providing a specially designed terminal and hull which ensure the safe connection (both mechanical and electrical) between the main body and the hull, without the necessity of soldering. According to this invention, each terminal has a notch at its free end to allow a certain degree of elastic compression of the free end so that the terminal can be easily driven into a corresponding hole in the hull of which the size is smaller than the size of the terminal. The structure of the terminal is such that the terminal, once driven into the hole, can no longer be pulled out, and the resumptive force causes the terminal to urge tightly on the edge of the hole, thus ensuring both mechanical and electrical connection between the hull and the main body. Accordingly, soldering is not necessary.

According to a further feature of this invention, the electrical connection between the main body and the hull is further ensured by two tongues on the sides of the hull which resiliently urges on the terminals.

This invention will be better understood when read in connection with the drawing, in which:

DETAILED DESCRIPTION OF PREFERRED EMBODIMENT

Figure 1:
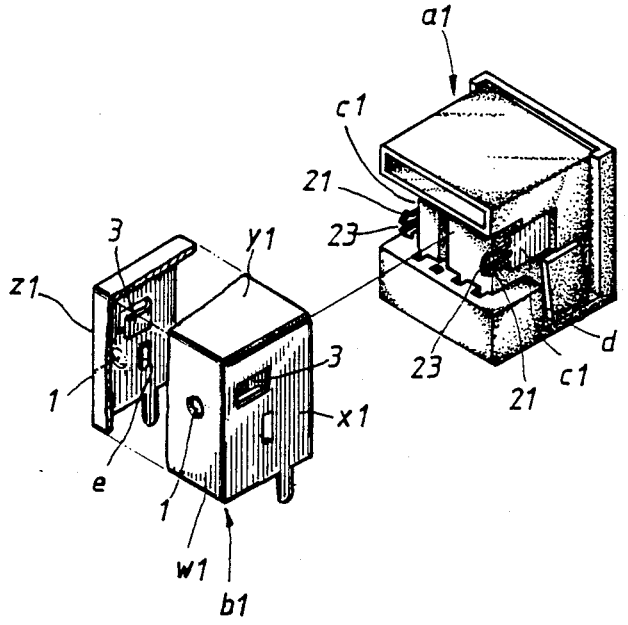
FIG. 1 is a fragmentary view of a DIN connector of this invention.

With reference to FIG. 1, the DIN connector of this invention also comprises a main body (a1) and a metallic hull (b1). Like the conventional DIN connector, the main body (a1) also has two notches (d) (only one is shown) for the projections (e) of the hull (e) and two grounding terminals (c1). But unlike the conventional DIN connector, the hull (b1) is not open at its rear side. In other words, it provides a shield for the rear side (W1) in addition to the three sides (X1) (Y1) and (Z1), thus eliminating the interference from the rear side. The rear side (W1) is provided with two holes (1) through which the tip (21) of each terminal (c1) is inserted. The tip (21) is arrow-shaped, and followed by a shank (22). A notch (22) extends a distance along the axial direction of the terminal (c1).

Figure 2:
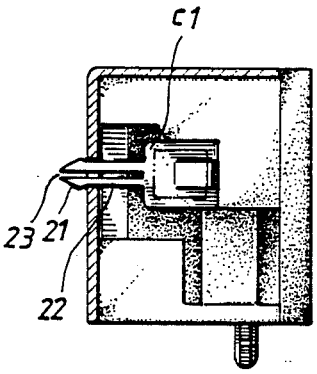
FIG. 2 is a sectional view showing the hull and the main body in assembled state.

Referring to FIG. 2, the normal width of the shank (22) is slightly greater than the size of the hole (1). Thus once a terminal (c1) is driven into a hole (1), the shank (22) is slightly compressed by the hole (1). Thus the shank (22) is forced by a resumptive force to contact tightly with the edge of the hole (1).

To further ensure the electrical connection between the main body (a1) and the hull (b1), the latter is provided with two tongues (3) which are punched out from the hull (b1) and which resiliently urge on the terminals (c1) when the terminals (c1) are driven in the holes (1).

Figure 3:
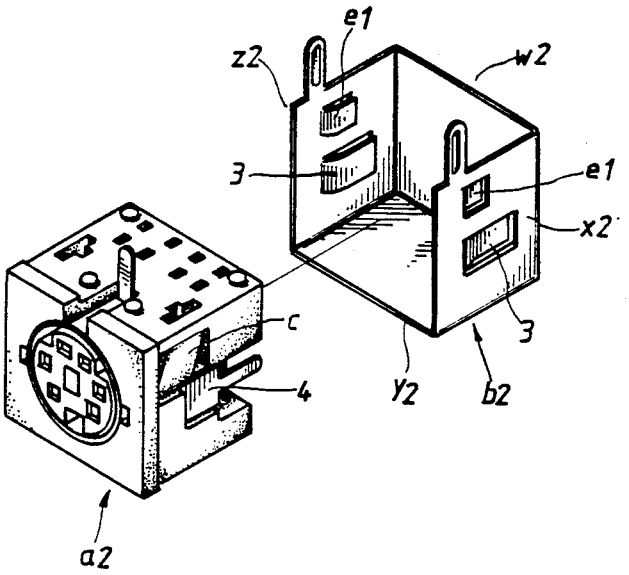
FIG. 3 is a modified DIN connector of this invention.
Figure 4:
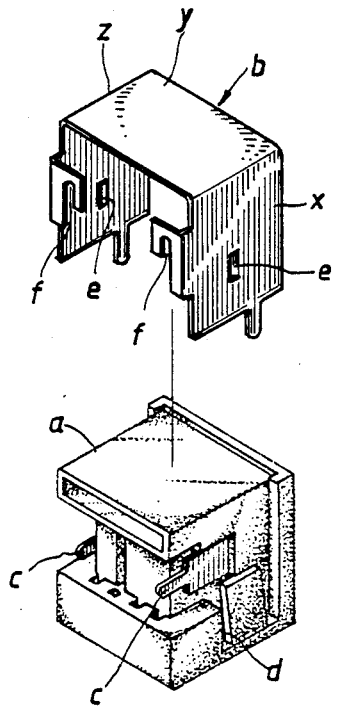
FIG. 4. PRIOR ART
FIG. 4 is a fragmentary view of a conventional DIN connector.

FIG. 3 show s another embodiment of this invention. Like the first embodiment in FIG. 1, the DIN connector also comprises a main body (a2) and a hull (b2) which has four sides (X2), (Y2), (Z2) and (W2). The hull (b2) also has two tongues (3) to ensure its electrical connection with the two terminals (c) (only one is shown) of the main body (a2). Here the terminal (c) is the same as the conventional DIN connector in FIG. 4. The hull (b2) is not provided with holes for the terminals. However, since the electrical connection is ensured by the resilience of the tongues (3), a soldering of the terminals (c) is not necessary. The hull (b2) has two further tongues (e1) which can respective engage into two recesses (4) (only one is shown) to ensure the mechanical connection between the main body (a2) and the hull (b2).

I claim:

1. A DIN connector comprising a main body substantially in form of a cubic body with two elongate grounding terminals and a metallic hull which is engageable with said main body and is in electrical connection with said grounding terminals when engaged therewith, said hull shielding at least three sides of said main body, characterized in that said hull further comprises an additional side through which said grounding terminals pass and shields a fourth side of said main body, said hull being provided with two tongues which respectively resiliently urges on each one of said terminals when said main body and said hull are engaged.

2. A DIN connector according to claim 1, wherein said additional side is provided with two holes, each of said terminals having an arrow-shaped tip and a shank behind said tip, with a notch extending a distance from said tip along the axial direction of said terminal, the diametrical dimension of eeach of said holes being smaller than the width of said shank, the tip of each terminal extending through one of said holes and the sides of said shank resiliently urging against the edge of said hole when siad main body and said hull are engaged.

* * * * *